US005588870A

United States Patent [19]

Boteler et al.

[11] Patent Number: 5,588,870

[45] Date of Patent: Dec. 31, 1996

[54] ELECTRICAL CORD CLAMP

[75] Inventors: William C. Boteler, Bridgeport; Lawrence J. Klein, Ansonia, both of Conn.

[73] Assignee: Hubbell Incorporated, Orange, Conn.

[21] Appl. No.: 486,162

[22] Filed: Jun. 7, 1995

[51] Int. Cl.[6] ..... H01R 13/58

[52] U.S. Cl. ..... 439/467

[58] Field of Search ..... 439/467, 465, 439/466, 460, 469

[56] References Cited

U.S. PATENT DOCUMENTS

| | | | |
|---|---|---|---|
| 3,393,395 | 7/1968 | Hubbell | 439/91 |
| 3,784,961 | 1/1974 | Gartland, Jr. | 439/107 |
| 3,856,376 | 12/1974 | Poliak et al. | 439/107 |
| 3,904,265 | 9/1975 | Hollyday et al. | 439/103 |
| 4,010,999 | 3/1977 | Hoffman | 439/107 |
| 4,080,036 | 3/1978 | Hagel | 439/103 |
| 4,108,527 | 8/1978 | Douty et al. | 439/107 |
| 4,138,185 | 2/1979 | Jaconette, Jr. | 439/107 |
| 4,178,056 | 12/1979 | Lee | 439/103 |
| 4,208,085 | 6/1980 | Lawrence et al. | 439/103 |
| 4,213,667 | 7/1980 | Wittes | 439/103 |
| 4,561,715 | 12/1985 | Sanchez | 439/103 |
| 4,721,483 | 1/1988 | Dickie | 439/610 |
| 4,722,580 | 2/1988 | Kocher et al. | 439/466 |
| 4,749,369 | 6/1988 | Wang | 439/459 |
| 4,921,441 | 5/1990 | Sauder | 439/460 |
| 4,963,104 | 10/1990 | Dickie | 439/460 |
| 5,217,389 | 6/1993 | MacKay et al. | 439/466 |
| 5,277,619 | 1/1994 | Yamamoto | 439/469 |
| 5,304,075 | 4/1994 | Hoffman | 439/472 |

*Primary Examiner*—Gary F. Paumen
*Assistant Examiner*—T. C. Patel
*Attorney, Agent, or Firm*—Jerry M. Presson; David L. Tarnoff

[57] ABSTRACT

An electrical cord clamp is disclosed for securing an end of an electrical cord to an electrical device or connector. The electrical cord clamp provides strain relief between the ends of the electrical conductors of the electrical cord and the terminals of the electrical device or connector. The cord clamp has a pair of clamping members slidably coupled to a pair of housing halves of the electrical device for slidably engaging the electrical cord upon installation thereon to pull the electrical cord towards the terminals of the electrical device or connector. The clamping members can have one or more spring elements or arms integrally formed therewith for normally biasing the clamping members to their original position prior to assembly within the electrical device or connector.

18 Claims, 5 Drawing Sheets

ELECTRICAL CORD CLAMP

FIELD OF THE INVENTION

This invention relates to an electrical cord clamp for securing an end of an electrical cord or cable to an electrical device or connector. More specifically, the present invention relates to an electrical cord clamp in combination with an electrical connector housing and a pair of inserts or clamping members for gripping the electrical cord to provide strain relief between the end of the electrical cord and the terminals of the electrical device or connector.

BACKGROUND OF THE INVENTION

Electrical devices such as electrical connectors typically have an electrical cord or cable extending outwardly from the device. It is necessary to securely fasten the electrical cord or cable to the electrical device or connector to prevent the electrical conductors from being pulled from their terminations, which can damage the conductors and the electrical device. If the electrical conductors are pulled or torn away from their terminations in the electrical device or connector, this can result in the electrical device or connector becoming inoperable, and in certain circumstances can result in serious injury to the user due to shorting of the electrical current being carried in the conductors.

Accordingly, many corded electrical devices or connectors have a strain relief assembly for gripping and coupling the electrical cord or cable thereto, and for maintaining slack between the ends of the conductors and their respective terminals or electrical connections within the electrical device or connector. Presently, there are a wide variety of strain relief assemblies available for electrical devices or connectors. For example, many electrical devices or connectors have a pair of cord or cable clamping members for gripping and coupling the electrical cord thereto. Typically, one of the cord or cable clamping members is stationary, while the other cord or cable clamping member is movable in a direction substantially perpendicular to the longitudinal axis of the electrical cord. The clamping members may include a rib or a series of ribs for engaging the electrical cord to ensure a good grip on the electrical cord.

Examples of some prior electrical connectors having a strain relief assembly with a stationary clamp and a movable clamp are disclosed in the following U.S. Pat. Nos.: 3,393,395 to Hubbell; 3,784,961 to Gartland, Jr.; 3,904,265 to Hollydale et al; 4,080,036 to Hagel; 4,178,056 to Lee; 4,213,667 to Wittes; 4,931,023 to Browne; 5,217,389 to MacKay et al; 5,304,075 to Hoffman; and 5,338,222 to Boteler.

However, these types of strain relief assemblies are often not suitable in certain circumstances and have certain drawbacks. For example, during clamping of the electrical cord, the installer must push the electrical cord towards the terminals and hold the electrical cord in this position, while at the same time tighten down the movable clamping member on the electrical cord. Moreover, some of these types of external clamps typically require a set of screws in addition to the screws for the electrical connector housing. Thus, this increases the costs of manufacturing such electrical connectors.

Examples of some other prior electrical connectors with internal strain relief are disclosed in the following U.S. Pat. Nos.: 3,437,980 to Smith; 3,856,376 to Poliak et al; 4,108,527 to Douty et al; 4,138,185 to Jaconette, Jr.; 4,208,085 to Lawrence et al; 4,561,715 to Sanchez; 4,721,483 to Dickie; 4,722,580 to Kocher et al; 4,749,369 to Wang; 4,921,441 to Sauder; 4,963,104 to Dickie; and 5,277,619 to Yamamoto.

However, these types of strain relief assemblies also suffer certain disadvantages. For example, some of the strain relief assemblies increase difficulty of assembling the electrical connectors. Moreover, some of these strain relief assemblies are difficult to manufacture and require special molding procedures which can significantly increase the total cost of the electrical connectors.

In view of the above, it is apparent that there exists a need for an electrical cord clamp for an electrical device or connector which will overcome the above-mentioned problems of the prior art devices. This invention addresses this need in the art along with other needs which will become apparent to those skilled in the art once given this disclosure.

SUMMARY OF THE INVENTION

One object of the present invention is to provide an electrical device with a strain relief cord clamp which is relatively quick and easy to assemble about an electrical cord.

Another object of the present invention is to provide an electrical device with a cord clamp which axially pulls the end of an electrical cord being coupled thereto during assembly for providing strain relief between the ends of the electrical conductors and the terminals of the electrical device.

Still another object of the present invention is to provide a cord clamp for an electrical device which can be economically manufactured.

The foregoing objects are basically attained by an electrical device adapted to be coupled to an end of an electrical cord with a plurality of conductors, comprising: a housing including first and second cover halves coupled together to form a cord receiving cavity therebetween, the first and second cover halves having first and second cord clamp engaging surfaces, respectively; a contact retainer body with terminals coupled to the first and second cover halves for coupling the electrical conductors thereto; and a cord clamp including a first clamping member movably coupled to the first cover half along the first cord clamp engaging surface, and a second clamping member movably coupled to the second cover half along the second cord clamp engaging surface, the first and second clamping members being positioned substantially opposite each other for movably engaging the electrical cord therewith upon installation and assembly of the housing thereon to pull the electrical cord within the cord receiving cavity towards the terminals, each of the first and second clamping members having a spring element for biasing the first and second clamping members away from the terminals.

Other objects, advantages and salient features of the present invention will become apparent to those skilled in the art from the following detailed description, which taken in conjunction with the annexed drawings, discloses preferred embodiments of the present invention.

BRIEF DESCRIPTION OF THE DRAWINGS

Referring now to the drawings which form part of this original disclosure.

DETAILED DESCRIPTION OF THE PREFERRED EMBODIMENTS

Referring initially to FIGS. 1–6, an electrical device or connector 10 with a strain relief arrangement is illustrated in accordance with a first embodiment of the present invention. While electrical device 10 is illustrated as a plug or a male electrical connector attached to one end of electrical cord 12, it will be apparent to those skilled in the art from this disclosure that electrical device 10 can be a female electrical connector as well as an electrical wiring device which in turn can be part of another device such as an appliance or tool.

Figure 1:
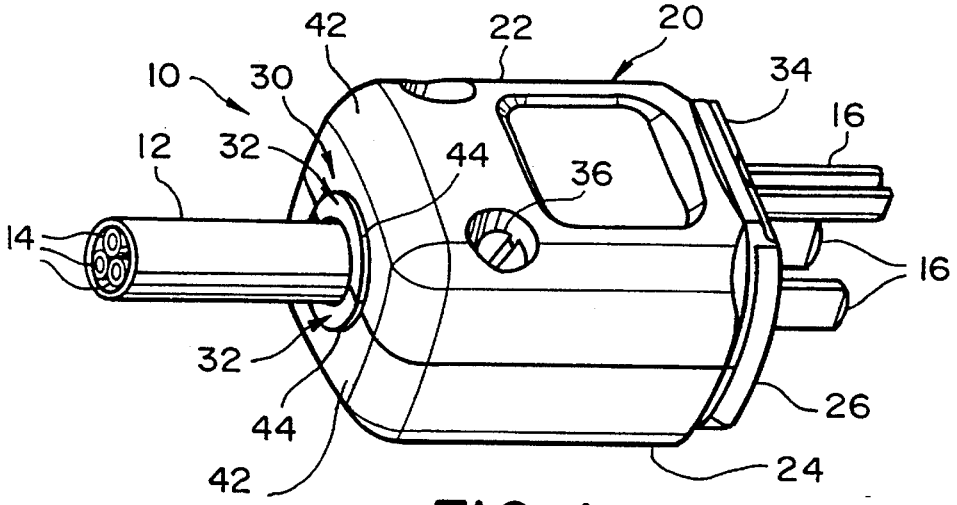
FIG. 1 is a rear end perspective view of an electrical device in the form of an electrical connector with an electrical cord clamp assembled thereto in accordance with a first embodiment of the present invention.

As seen in FIG. 1, electrical cord 12 is a conventional electrical cord, and thus, will not be discussed in detail. By way of example, electrical cord 12, as seen in the drawings, preferably has three electrical conductors 14 which have a conducting core and an insulating sheath thereon. The ends of the electrical conductors 14 are stripped for attaching to terminals 16. While three conductors 14 are illustrated, it will be apparent to those skilled in the art that the present invention can be utilized with an electrical cord with two electrical conductors or with an electrical cord more than three electrical conductors. Of course, electrical connector 10 would have to be modified to accommodate the additional conductor or conductors.

Figure 2:
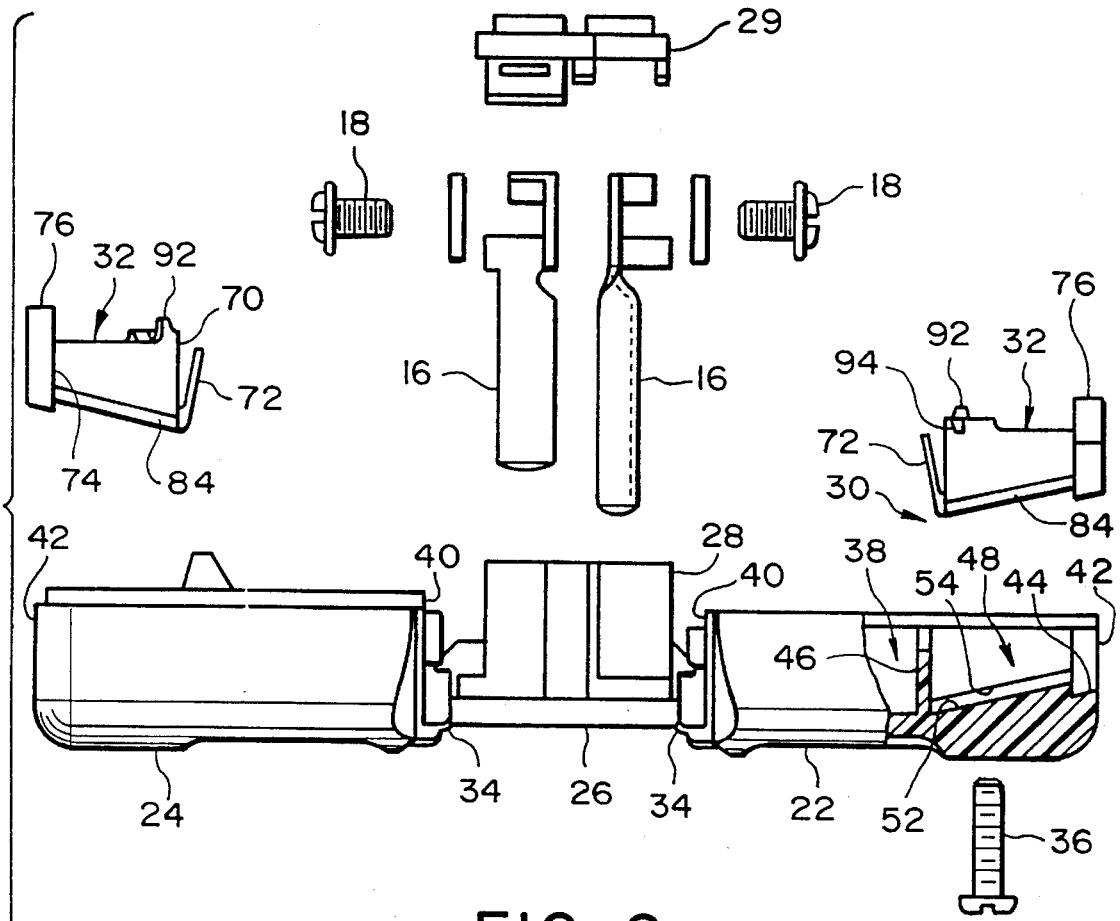
FIG. 2 is an exploded elevational view of the electrical connector and the electrical cord clamp illustrated in FIG. 1.
Figure 3:
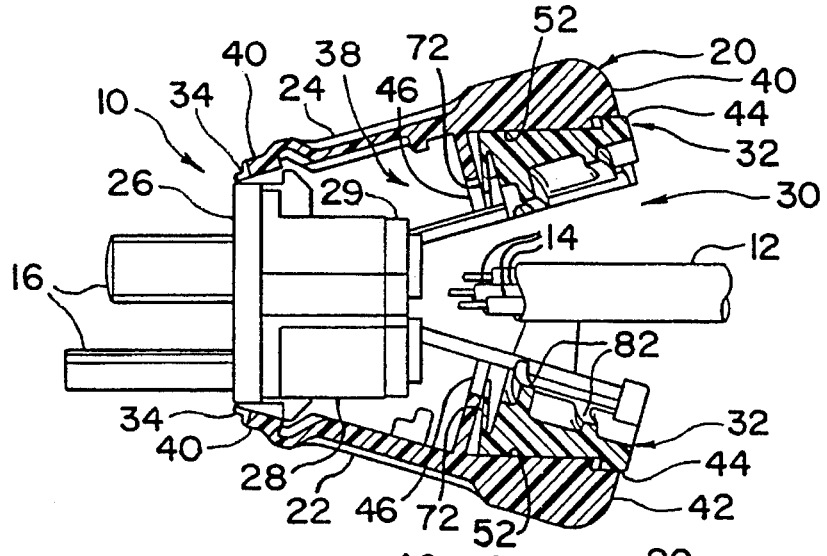
FIG. 3 is a longitudinal cross-sectional view of the electrical connector and the electrical cord clamp illustrated in FIGS. 1 and 2 with an electrical cord about to be installed therein.

As seen in FIG. 2, electrical connector 10 includes a housing 20 with a first cover half 22, a second cover half 24, a front cover face 26 and a contact retainer body 28 with a funnel cap 29. Electrical connector housing 20 is a modified version of the electrical connector housings illustrated and disclosed in U.S. Pat. No. 4,010,999 to Hoffman and U.S. Pat. No. 4,138,185 to Jaconette, Jr. The disclosure of these two U.S. patents are hereby incorporated herein by reference. Moreover, electrical connector housing 20 along with its contact retainer body 28 and funnel cap 29 are discussed in U.S. patent application Ser. No. 08/474,171 (RAB&G 32308), filed concurrently herewith in the name of John L. Sandor and entitled "Electrical Connector with Funnel Cap". The disclosure of this application is also incorporated herein by reference. Accordingly, electrical connector housing 20 will only be discussed herein as necessary to understand the present invention.

Electrical connector 10 also includes a cord clamp 30 movably coupled within housing 20. Cord clamp 30 includes a pair of clamping members 32 which are designed to provide strain relief for an electrical cord 12 coupled to electrical connector 10. More specifically, clamping members 32 of cord clamp 30 engage electrical cord 12 during assembly of electrical connector 10 to axially pull electrical cord 12 towards terminals 16 of electrical connector 10.

Preferably, first cover half 22, second cover half 24 and front cover face 26 along with contact retainer body 28 are integrally formed as a one-piece, integral unit of a suitable insulating material such as nylon. More specifically, first cover half 22 and second cover half 24 are hinged to front cover face 26 by web hinges 34, while contact retainer body 28 is integrally formed with front cover face 26 and extends from the interior surface of front cover face 26 between cover halves 22 and 24.

Electrical connector housing 20 is held in its assembled position by a pair of screws 36. Of course, other types of fastening members can be used to hold cover halves 22 and 24 together. For example, U.S. Pat. Nos. 4,108,527 to Douty et al and 5,217,389 to MacKay et al disclose cover halves coupled together using fasteners other than screws which could be utilized to interconnect first cover half 22 and second cover half 24 together.

Cover halves 22 and 24 are substantially identical for purposes of discussion of this invention. Of course, as seen in the Figures, there are some minor differences between cover halves 22 and 24 for mating of cover halves 22 and 24 together during assembly thereof. Accordingly, like reference numerals will be utilized to discuss the parts which are common between cover halves 22 and 24.

Referring now to FIGS. 3–6, cover halves 22 and 24 form a cord receiving cavity 38 for receiving cord clamp 30, electrical cord 12 and contact retainer body 28 therein. More specifically, each of the cover halves 22 and 24 have an open end 40 coupled to front cover face 26 by web hinges 34, and a closed end 42 with a semi-circular cord opening 44. Each of the cover halves 22 and 24 further includes rib 46 adjacent its respective cord opening 44 for clamping electrical cord 12 when cord clamp 30 is not utilized.

As best seen in FIG. 2, clamping members 32 are received and retained within channels 48 which are formed adjacent cord openings 44 of cover halves 22 and 24. Each of the channels 48 has an inclined surface or ramp 52 and a pair of grooves 54 which are designed to control the sliding movement of clamping member 32 therein. Clamping members 32 slide along inclined surfaces or ramps 52 of cover halves 22 and 24 upon assembly of electrical connector housing 20 about the end of electrical cord 12.

Inclined surfaces or ramps 52 are preferably smooth, flat surfaces that extend at an angle to the longitudinal axis of electrical cord 12. Each of the inclined surfaces or ramps 52 can be formed either as a single flat continuous surface or as a plurality of discontinuous surfaces by a plurality of ribs as shown in the next embodiment. In any event, inclined surfaces or ramps 52 diverge away from each other as they approach terminals 16. In other words, inclined surfaces or ramps 52 are spaced closer together at ends 42 of cover halves 22 and 24 then at ribs 46. When cover halves 22 and 24 are pivoted together, inclined surfaces or ramps 52 converge towards each other so as to force clamping members 32 into housing 20. Accordingly, as discussed in more detail below, assembly of cover halves 22 and 24 causes clamping members 32 to slide within channels 48 along inclined surfaces or ramps 52 of housing 20 towards terminals 16 to axially pull electrical cord 12 towards terminals 16.

As seen in FIG. 2, clamping members 32 are substantially identical, and each has a body portion having a first end 70 with a spring member or element 72 extending outwardly therefrom, and a second end 74 with a curved flange 76. Clamping members 32 are preferably integrally molded as a one-piece, unitary member from a suitable material such as plastic. One suitable material is nylon.

Referring now to FIGS. 7–12, clamping members 32 also each includes a curved cord recess 78 extending between first and second ends 70 and 74 for engaging electrical cord 12, and an inclined outer surface 80 for engaging its respective ramp 52. Cord recess 76 is preferably shaped as a half cylinder with a pair of cord gripping ribs 82 formed thereon.

Spring members or elements 72 of clamping members 32 are designed to engage rib 46 of its respective cover half 22 or 24 so that cord clamping members 32 are normally biased towards end 42 of cover halves 22 and 24. When cover halves 22 and 24 are pivoted together about electrical cord 12, clamping members 32 are forced down ramps 52 against the force of spring elements 72. Preferably, spring elements 72 are leaf springs.

Curved flange 76 is designed so that it extends approximately 180°, with one end being positioned higher than the other end to form a tooth 88 and a notch 90. The other end 70 of each of the clamping members 32 is also provided with a tooth 92 and a notch 94. These tooth and notch arrangements of clamping members 32 are designed to cooperate with each other so that clamping members 32 properly mate together. Thus, clamping members 32 slide together during coupling of housing 20 about electrical cord 12. Each of the flanges 76 also extends downwardly relative to inclined outer surface 80 so as to form an abutment surface 86 for engaging an abutment surface formed in its respective cover half 22 or 24.

Each of the clamping members 32 is also releasably retained within cover halves 22 and 24, respectively, by a grooves 54 of cover halves 22 and 24. In particular, each of the clamping members 32 is provided with an elongated protrusion 84 on each of its sides which is slidably received within elongated grooves 54 in cover halves 22 and 24.

Accordingly, when clamping members 32 are coupled to cover halves 22 and 24 respectively, inclined surfaces 80 of clamping members 32 engage inclined surfaces or ramps 52 of cover halves 22 and 24 with spring elements 72 engaging ribs 46, while protrusions 84 of clamping members 32 slidably engaging grooves 54 of its respective cover halves 22 and 24.

Assembly of Electrical Cord Connector 10

Electrical cord connector 10 is assembled by first installing terminals 16 into contact retainer body 28 such that their blade portions extend outwardly from front cover face 26 via openings formed therein. Next, funnel cap 29 is coupled to contact retainer body 28 via a snap-fit. Now, conductors 14 are connected in funnel cap 29 of contact retainer body 28 such that the stripped ends of the electrical conductors 14 engage terminals 16. Then, the terminal screws 18 are tightened down so that the stripped ends of electrical conductors 14 are electrically and fixedly coupled to terminals 16 in a conventional manner.

Figure 4:
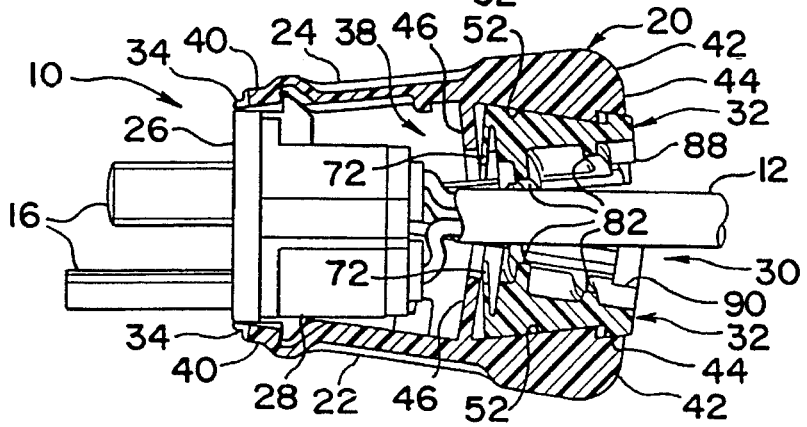
FIG. 4 is a partial longitudinal cross-sectional view of the electrical connector and the electrical cord clamp illustrated in FIGS. 1–3 with the housing partially assembled on the electrical cord and the clamping members initially engaging the electrical cord.
Figure 5:
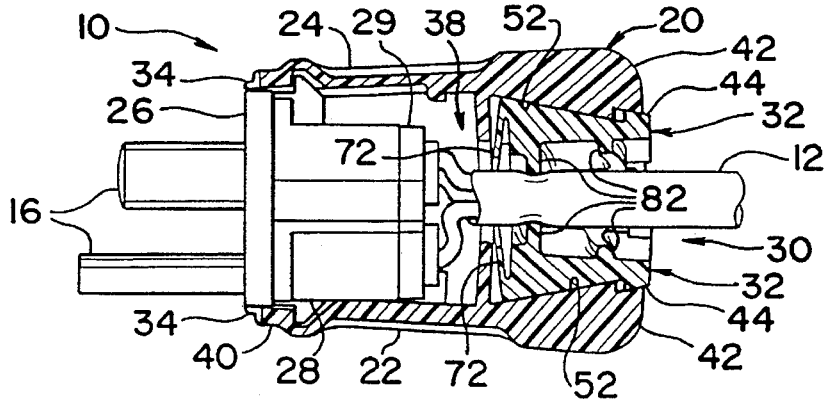
FIG. 5 is a partial longitudinal cross-sectional view of the electrical connector and the electrical cord clamp illustrated in FIGS. 1–4 with the housing partially assembled on the electrical cord and the clamping members engaging each other, but prior to sliding of the clamping members.
Figure 6:
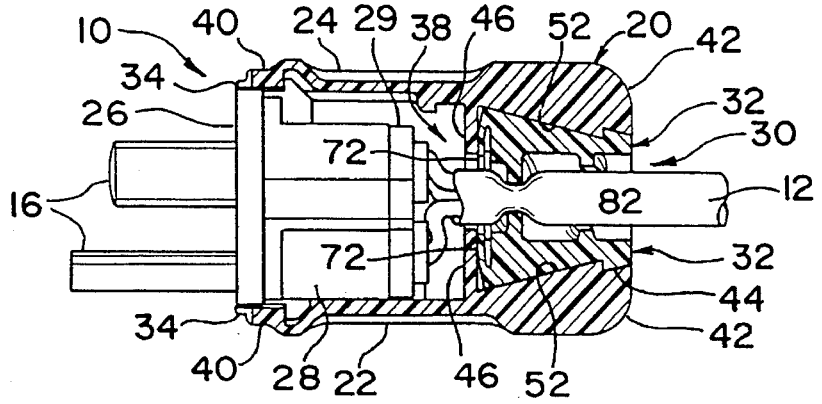
FIG. 6 is a partial longitudinal cross-sectional view of the electrical connector and the electrical cord clamp illustrated in FIGS. 1–5 with the housing fully assembled on the electrical cord and the clamping members fully moved along their ramps.
Figure 7:
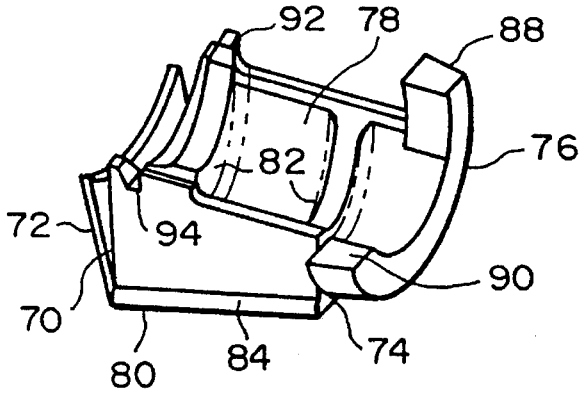
FIG. 7 is a perspective view of one of the clamping members for the cord clamp of the electrical connector illustrated in FIGS. 1–6.
Figure 8:
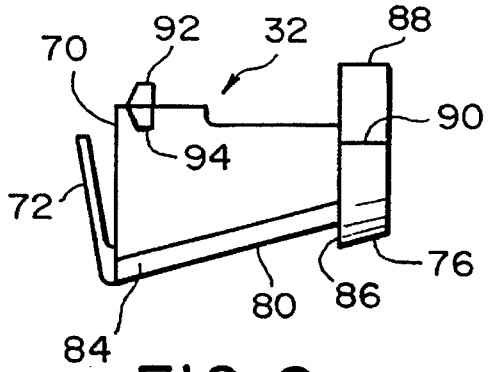
FIG. 8 is a first side elevational view of the clamping member illustrated in FIG. 7 for the cord clamp of the electrical connector illustrated in FIGS. 1–6.
Figure 9:
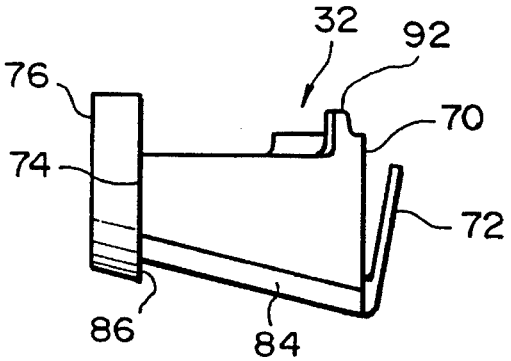
FIG. 9 is a second side elevational view of the clamping member illustrated in FIGS. 7 and 8 for the cord clamp of the electrical connector illustrated in FIGS. 1–6.
Figure 10:
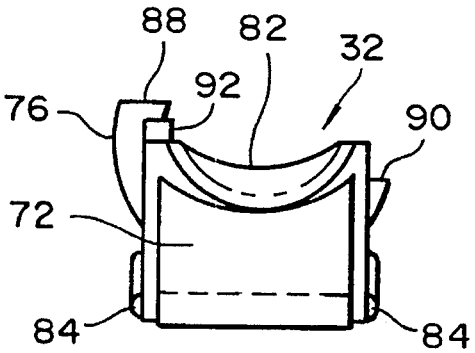
FIG. 10 is a left end elevational view of the clamping member illustrated in FIGS. 7–9 for the cord clamp of the electrical connector illustrated in FIGS. 1–6.
Figure 11:
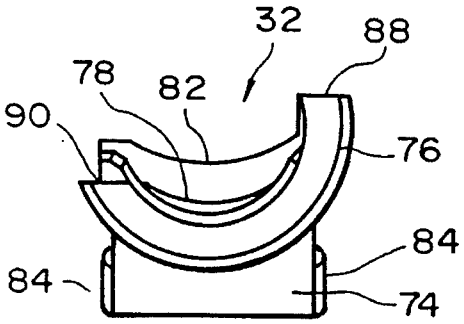
FIG. 11 is a right end elevational view of the clamping member illustrated in FIGS. 7–10 for the cord clamp of the electrical connector illustrated in FIGS. 1–6.
Figure 12:
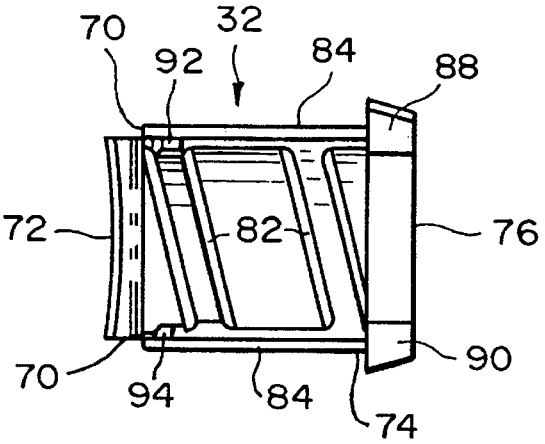
FIG. 12 is a top plan view of the clamping member illustrated in FIGS. 7–11 for the cord clamp of the electrical connector illustrated in FIGS. 1–6.

After electrical conductors 14 are coupled to terminals 16, one of the housing halves 22 or 24 is pivoted so as to form a 90° angle with front cover face 26. In this position, the end of electrical cord 12 is resting on the clamping members 32 of the pivoted cover half. The installer then pivots the other cover half 22 or 24 so that its clamping member 32 engages electrical cord 12. In this position, as seen in FIG. 4, clamping members 32 are still held in their initial position by spring elements 72.

Now, the installer squeezes cover halves 22 and 24 together which causes rib 82 of clamping members 32 to squeeze and grip electrical cord 12. When electrical cord 12 is fully compressed between ribs 82 of clamping members 32, further squeezing of cover halves forces clamping members 32 down inclined surfaces or ramps 52 against the force of spring element 72. This sliding movement of clamping members 32 causes electrical cord 12 to move into housing 20. Preferably, clamping members 32 and electrical cord 12 are axially displaced in the range of about 0.031 inch to about 0.092 inch. In other words, clamping members 32 axially pull electrical cord 12 towards terminals 16 to provide slack between the ends of conductors 14 and terminals. This provides strain relief between the end of electrical cord 12 and terminals 16. Once cover halves 22 and 24 are completely pivoted to their closed positions, screws 36 are threaded into housing 20 to secure cover halves 22 and 24 together about the end of electrical cord 12.

Electrical Device or Connector 110

Referring now to FIGS. 13–21, an electrical device or cord connector 110 with a strain relief arrangement is illustrated in accordance with a second embodiment of the present invention. More specifically, electrical connector 110 is attached to one end of an electrical cord 112 such that during assembly thereof, the strain relief arrangement of electrical connector 110 will axially pull electrical cord 112 therein.

Figure 13:
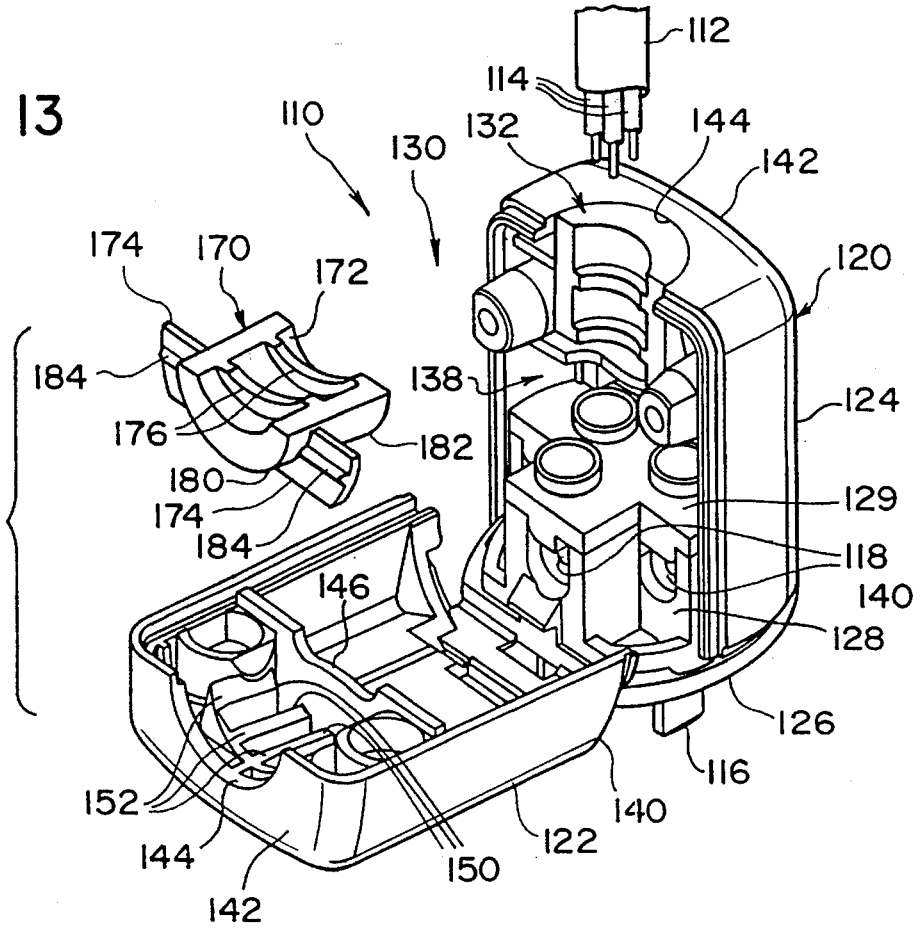
FIG. 13 is a partially exploded perspective view of an electrical connector and an electrical cord clamp in accordance with a second embodiment of the present invention.

As seen in FIG. 13, electrical cord 112 is a conventional electrical cord, and thus, will not be discussed in detail. By way of example, electrical cord 112, as seen in the drawings, preferably has three electrical conductors 114 which have a conducting core and an insulating sheath thereon. The ends of the electrical conductors 114 are stripped for attaching to terminals 116. While three conductors 114 are illustrated, it will be apparent to those skilled in the art that the present invention can be utilized with an electrical cord with two electrical conductors or with an electrical cord more than three electrical conductors. Of course, electrical connector 110 would have to be modified to accommodate the additional conductor or conductors.

Electrical connector 110 includes an electrical connector housing 120 with a first cover half 122, a second cover half 124, a front cover face 126 and a contact retainer body 128 with a funnel cap 129. Electrical connector 110 also includes a cord clamp 130 movably coupled within housing 120. Cord clamp 130 includes a pair of clamping members 132 which are designed to provide strain relief for an electrical cord 112 coupled to electrical connector 110. More specifically, clamping members 132 of cord clamp 130 engage electrical cord 112 during assembly of electrical connector 110 to axially pull electrical cord 112 towards terminals 116 of electrical connector 110.

Preferably, first cover half 122, second cover half 124 and front cover face 126 along with contact retainer body 128 are integrally formed as a one-piece, integral unit of a suitable insulating material such as nylon. More specifically, first cover half 122 and second cover half 124 are hinged to front cover face 126 by web hinges 134, while contact retainer body 128 is integrally formed with front cover face 126 and extends from the interior surface of front cover face 126 between cover halves 122 and 124.

Electrical connector housing 120 is held in its assembled position by a pair of screws (not shown). Of course, other types of fastening members can be used to hold cover halves 122 and 124 together.

Cover halves 122 and 124 are substantially identical for purposes of discussion of this invention. Of course, as seen in the Figures, there are some minor differences between cover halves 122 and 124 for mating of cover halves 122 and 124 together during assembly thereof. Accordingly, like reference numerals will be utilized to discuss the parts which are common between cover halves 122 and 124.

Cover halves 122 and 124 form a cord receiving cavity 138 for receiving cord clamp 130, electrical cord 112 and contact retainer body 128 therein. More specifically, each of the cover halves 122 and 124 have an open end 140 coupled to front cover face 126 by web hinges 134, and a closed end 142 with a semi-circular cord opening 144. Each of the cover halves 122 and 124 further includes a rib 146 adjacent its respective cord opening 144 for clamping electrical cord 112 when cord clamp 130 is not utilized.

Figure 14:
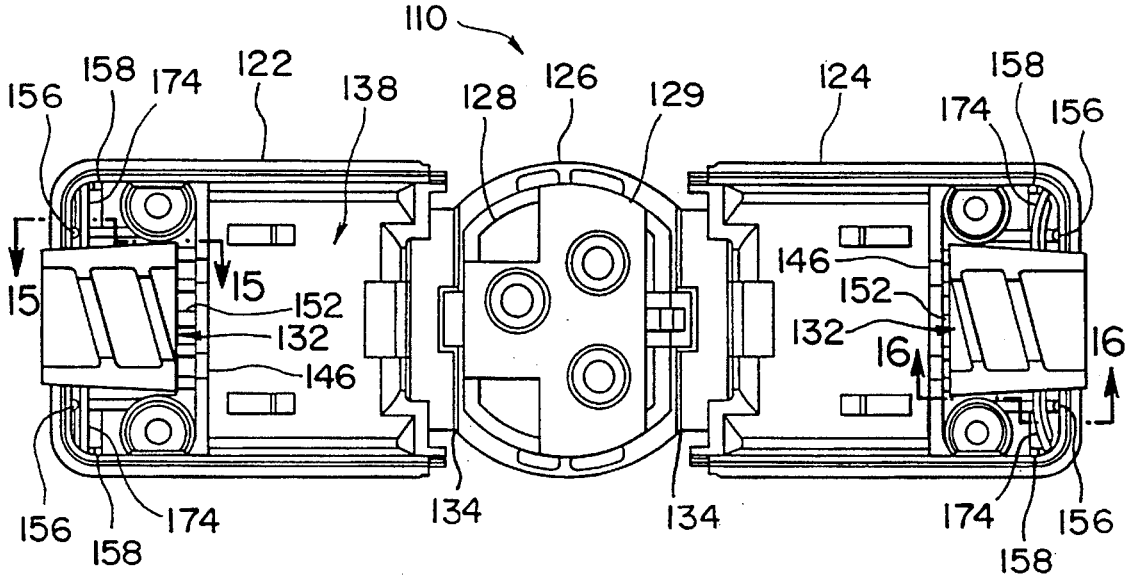
FIG. 14 is a top plan view of the electrical connector illustrated in FIG. 13 with one of its clamping members moved to its cord strain relief position, while the other of its clamping members is illustrated in its rest position.

As best seen in FIGS. 13 and 14, clamping members 132 are received and retained within channels 148 which are formed adjacent cord openings 144 of cover halves 122 and 124. Each of the channels 148 has a plurality of ribs 150 which form inclined surfaces or ramps 152, a pair of bumps 156 formed on end 142 of its respective cover half 122 or 124 and a pair of flanges or ribs 158 formed on the side walls of its respective cover half 122 or 124. Ribs 158 and bumps 156 of each of the cover halves 122 and 124 are designed to retain their respective clamping member 132 therein as explained below. Clamping members 132 slide along inclined surfaces or ramps 152 of cover halves 122 and 124 upon assembly of electrical connector housing 120 about the end of electrical cord 112 so as to pull electrical cord 112 into housing 120 as explained below.

Inclined surfaces or ramps 152 are preferably smooth, flat surfaces that extend at an angle to the longitudinal axis of electrical cord 112. Each of the inclined surfaces or ramps 152 is preferably formed by a plurality of ribs 150 which are arranged to form a curved ramp on each of the cover halves. In any event, inclined surfaces or ramps 152 diverge away from each other as they approach terminals 116. In other words, inclined surfaces or ramps 152 are spaced closer together at ends 142 of cover halves 122 and 124 then at ribs 146. When cover halves 122 and 124 are pivoted together, inclined surfaces or ramps 152 converge towards each other so as to force clamping members 132 into housing 120. Accordingly, as discussed in more detail below, assembly of cover halves 122 and 124 causes clamping members 132 to slide within channels 148 along inclined surfaces or ramps 152 of housing 120 towards terminals 116 to axially pull electrical cord 112 towards terminals 116.

As seen in FIGS. 13 and 14, clamping members 132 are substantially identical, and each has a body portion 170 with a cord receiving recess 172 and a pair of spring members or elements 174 extending outwardly therefrom. Clamping members 132 are preferably integrally molded as a one-piece, unitary member from a suitable material such as plastic. One suitable material for clamping members 132 is nylon.

Referring now to FIGS. 13 and 17–21, cord recesses 172 of each of the clamping members 132 are formed so as to extend longitudinally along its respective body portion 170. Each of the cord recesses 172 is preferably shaped as a half cylinder with a pair of cord gripping ribs 176 formed thereon for gripping electrical cord 112.

Spring members or elements 174 of clamping members 132 are designed to engage ribs 158 and bumps 156 of its respective cover half 122 or 124 so that cord clamping members 132 are normally held at second ends 142 of cover halves 122 and 124. When cover halves 122 and 124 are pivoted together about electrical cord 112, clamping members 132 are forced down ramps 152 against the force of spring elements 174. Preferably, spring elements 174 are leaf springs which extend substantially perpendicular to body portion 170 of its respective clamping member 132.

Body portion 170 of each of the clamping members 132 has a first frustoconical surface 180 formed on one side of spring elements 174 and a second frustoconical surface 182 on the other side of spring elements 174. Surfaces 180 and 182 of each of the clamping members 132 form a curved inclined sliding surface for engaging its respective ramp 152 of its respective cover half 122 or 124.

Figure 15:
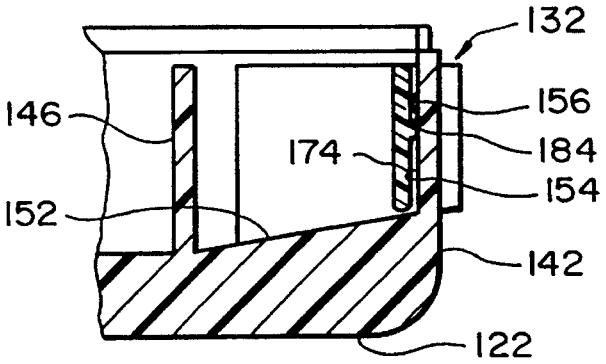
FIG. 15 is a partial cross-sectional view of the electrical connector illustrated in FIGS. 13 and 14 taken along section line 15—15 of FIG. 13.
Figure 16:
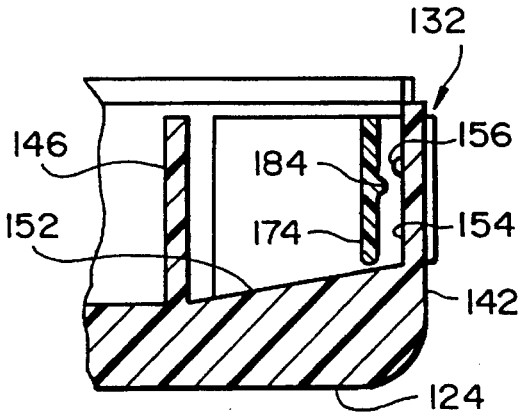
FIG. 16 is a partial cross-sectional view of the electrical connector illustrated in FIGS. 13 and 14 taken along section line 16—16 of FIG. 13.
Figure 17:
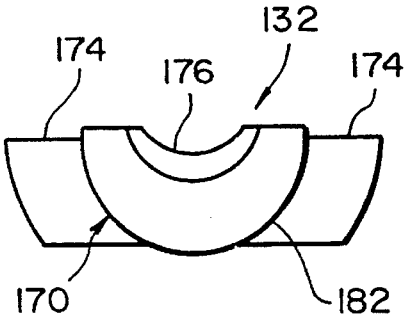
FIG. 17 is a left end elevational view of one of the clamping members for the cord clamp of the electrical connector illustrated in FIGS. 13 and 14.
Figure 18:
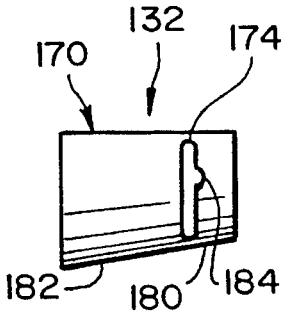
FIG. 18 is a side elevational view of the clamping member illustrated in FIG. 17 for the cord clamp of the electrical connector illustrated in FIGS. 13 and 14.
Figure 19:
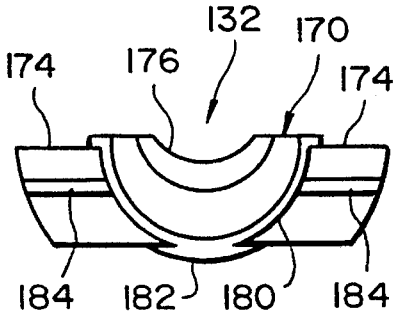
FIG. 19 is a right end elevational view of the clamping member illustrated in FIGS. 17 and 18 for the cord clamp of the electrical connector illustrated in FIGS. 13 and 14.
Figure 20:
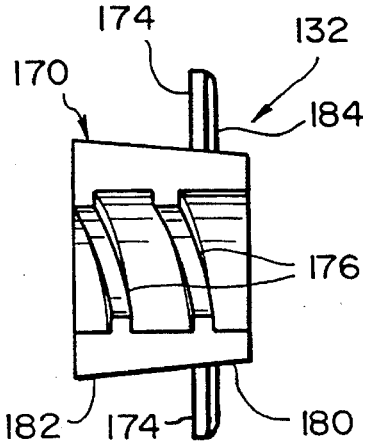
FIG. 20 is a top plan view of the clamping member illustrated in FIGS. 17–19 for the cord clamp of the electrical connector illustrated in FIGS. 13 and 14.
Figure 21:
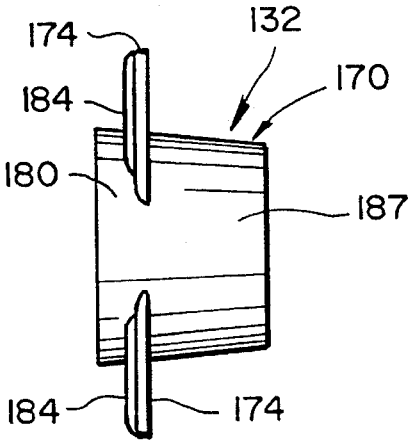
FIG. 21 is a bottom plan view of the clamping member illustrated in FIGS. 17–20 for the cord clamp of the electrical connector illustrated in FIGS. 13 and 14.

As seen in FIGS. 15 and 16, each of the clamping members 132 is also releasably retained within cover halves 222 and 124, respectively, by bumps 156 of cover halves 122 and 124. In particular, each of the spring elements 174 of clamping members 132 is provided with an elongated protrusion or rib 184 on one of its sides. When clamping members 132 are installed into cover halves 122 and 124, ribs 184 engage bumps 156, causing spring elements 174 to bend. This allows ribs 184 to ride over bumps 156 of ends 142 so that they rest under bumps 156 as seen in FIG. 15.

Accordingly, when clamping members 132 are coupled to cover halves 122 and 124 respectively, inclined surfaces 180 of clamping members 132 engage inclined surfaces or ramps 152 of cover halves 122 and 124 with spring elements 174 engaging ribs 146, while protrusions or ribs 184 of clamping members 132 engage bumps 156 of cover halves 122 and 124 to retain clamping members 132 therein.

Assembly of Electrical Cord Connector 110

Electrical cord connector 110 is assembled by first installing terminals 116 into contact retainer body 128 such that their blade portions extend outwardly from front cover face 126 via openings formed therein. Next, funnel cap 129 is coupled to contact retainer body 128 via a snap-fit. Now, conductors 114 are connected in funnel cap 129 of contact retainer body 128 such that the stripped ends of the electrical conductors 114 engage terminals 116. Then, the terminal screws 118 are tightened down so that the stripped ends of electrical conductors 114 are electrically and fixedly coupled to terminals 116 in a conventional manner.

After electrical conductors 114 are coupled to terminals 116, one of the housing halves 122 or 124 is pivoted so as to form a 90° angle with front cover face 126. In this position, the end of electrical cord 112 is resting on the clamping members 132 of the pivoted cover half. The installer then pivots the other cover half 122 or 124 so that its clamping member 132 engages electrical cord 112. In this position, clamping members 132 are still held in their initial position by spring elements 174.

Now, the installer squeezes cover halves 122 and 124 together which causes rib 176 of clamping members 132 to squeeze and grip electrical cord 112. When electrical cord 112 is fully compressed between ribs 176 of clamping members 132, further squeezing of cover halves forces clamping members 132 down inclined surfaces or ramps 152 against the force of spring element 174. This sliding movement of clamping members 132 causes electrical cord 112 to move into housing 120. In other words, clamping members 132 axially pull electrical cord 112 towards terminals 116 to provide slack between the ends of conductors 114 and terminals 116. Preferably, clamping members 132 and cord 112 are axially displaced in the range of about 0.031 inch to about 0.092 inch. This provides strain relief between the end of electrical cord 112 and terminals 116. Once cover halves 122 and 124 are completely pivoted to their closed positions, a pair of screws (not shown) are threaded into housing 120 to secure cover halves 122 and 124 together about the end of electrical cord 112.

While various embodiments have been chosen to illustrate the invention, it will be understood by those skilled in the art that various changes and modifications can be made herein without departing from the scope of the invention as defined in the appended claims.

What is claimed is:

1. An electrical wiring device adapted to be coupled to an end of an electrical cord with a plurality of electrical conductors, comprising:

a housing including first and second cover halves coupled together to form a cord receiving cavity therebetween, said first and second cover halves having first and second cord clamp engaging surfaces, respectively:

a contact retainer body with terminals coupled to said first and second cover halves for coupling the electrical conductors thereto; and a cord clamp including a first clamping member movably coupled within said cord receiving cavity along said first cord clamp engaging surface, and a second clamping member movably coupled within said cord receiving cavity along said second cord clamp engaging surface, said first and second clamping members being positioned substantially opposite each other for movably engaging the electrical cord therewith upon installation and assembly of said housing thereon to pull the electrical cord within said cord receiving cavity towards said terminals, each of said first and second clamping members having a spring element for biasing said first and second clamping members away from said terminals, said first and second cord clamp engaging surfaces being first and second substantially smooth, inclined ramps, respectively, which allows said first and second clamping members to freely slide thereon during assembly and disassembly of said housing.

2. An electrical wiring device according to claim 1, wherein each of said spring elements is integrally formed with its respective said first and second clamping members as a one-piece, unitary member.

3. An electrical wiring device according to claim 2, further comprising first retaining means for slidably coupling said first clamping member to said first cover half, and second retaining means for slidably coupling said second clamping members to said second cover half.

4. An electrical wiring device according to claim 3, wherein said first retaining means includes a first pair of elongated grooves formed on said first cover half and extending substantially parallel to said first cord clamp engaging surface, and a first pair of protrusions formed on opposite sides of said first clamping members; and said second retaining means includes a second pair of elongated grooves formed on said second cover half and extending substantially parallel to said second cord clamp engaging surface, and a second pair of protrusions formed on opposite side of said second clamping member.

5. An electrical wiring device according to claim 4, wherein said spring elements are leaf springs.

6. An electrical wiring device according to claim 1, wherein each of said first and second clamping members has a body portion with a first end and a second end, said first clamping member having a first inclined surface and said second clamping member having a second inclined surface, said first and second inclined surfaces extending between said first and second ends of said first and second clamping members, respectively, for slidably engaging said first and second inclined ramps, respectively.

7. An electrical wiring device according to claim 6, wherein said first clamping member includes a pair of first spring elements, and said second clamping member includes a pair of second spring elements.

8. An electrical wiring device according to claim 6, wherein each of first and second clamping members has a body portion with a cord recess and at least one cord gripping rib.

9. An electrical wiring device according to claim 6, wherein each of said body portions has an inclined curved outer surface for engaging said inclined ramps of said first and second cover halves, respectively.

10. An electrical wiring device according to claim 6, wherein said first and second inclined surfaces of said first and second clamping members are substantially flat, smooth surfaces.

11. An electrical wiring device according to claim 10, wherein said spring elements are integrally formed on said first ends of said body portions of said clamping members.

12. An electrical wiring device according to claim 11, wherein said body portion of said first clamping member is provided with an outwardly extending first tooth and a first notch; and said body portion of said second clamping member is provided with a second outwardly extending tooth for mating with said first notch and a second notch for mating with said first tooth so that said clamping members move together.

13. An electrical wiring device according to claim 6, wherein said housing further includes a front cover face hinged to first ends of said first and second cover halves.

14. An electrical wiring device according to claim 13, wherein said contact retainer body is coupled to said front cover face.

15. An electrical wiring device according to claim 14, wherein said housing is formed as a one-piece, unitary member from an insulating material.

16. An electrical wiring device according to claim 6, wherein said first and second spring elements are integrally formed with said first and second clamping members, respectively.

17. An electrical wiring device according to claim 16, wherein said first spring element includes a first protrusion for engaging a first notch formed on said first cover half, and said second spring element includes a second protrusion for engaging a second notch formed on said second cover half.

18. An electrical wiring device according to claim 16, wherein said first spring elements extend outwardly from side surfaces of said body portion of said first clamping member, and said second spring elements extend outwardly from side surfaces of said body portion of said second clamping member.

* * * * *